United States Patent [19]

Schumaker

[11] Patent Number: 4,646,205

[45] Date of Patent: Feb. 24, 1987

[54] EXAMINING LAMP

[75] Inventor: Michael J. Schumaker, Milwaukee, Wis.

[73] Assignee: Adjustable Fixture Company, Milwaukee, Wis.

[21] Appl. No.: 784,487

[22] Filed: Oct. 4, 1985

[51] Int. Cl.[4] ..... F21V 9/02

[52] U.S. Cl. ..... 362/2; 362/804; 362/350; 362/344

[58] Field of Search ..... 362/804, 341, 343, 344, 362/347, 350, 294, 2

[56] References Cited

U.S. PATENT DOCUMENTS

| | | | |
|---|---|---|---|
| 1,898,166 | 2/1933 | Bean | 362/350 |
| 2,831,104 | 4/1958 | Brandt | 362/343 |
| 3,322,946 | 5/1967 | Cooper | 362/2 |
| 4,072,856 | 2/1978 | Eligehausen | 362/2 |
| 4,254,455 | 3/1981 | Neal, Jr. | 362/347 |
| 4,302,801 | 11/1981 | Duddy | 362/350 |

FOREIGN PATENT DOCUMENTS

| | | | |
|---|---|---|---|
| 100779 | 4/1937 | Australia | 362/2 |
| 282149 | 12/1927 | United Kingdom | 362/2 |
| 362610 | 12/1931 | United Kingdom | 362/2 |

OTHER PUBLICATIONS

Adjustable Fixture Co. Catalog No. 73, 5/1911.
Medical Illumination Inc. Brochure, 10/1979.
Burton Brochure, 12/1979.
Adjustable Fixture Co. Bulletin No. 380, 5/1911.

*Primary Examiner*—E. Rollins Cross
*Attorney, Agent, or Firm*—Fred Wiviott

[57] ABSTRACT

A medical examining lamp has a generally parabolic reflector, a socket for receiving an incandescent lamp and a removable shield mounted adjacent the open end of the reflector and in alignment with the socket. The reflector has a blue anodized surface to color correct the incandescent lamp.

3 Claims, 2 Drawing Figures

EXAMINING LAMP

BACKGROUND OF THE INVENTION

This invention relates to lamps and more particularly to medical examining lamps.

Medical examining lamps, preferably project light which approximates that of daylight so that the patient's skin tones will appear natural. However, because incandescent lamps have a color temperature in the range of 2600° K.—2900° K. which appears yellow, prior art medical examining lamps employ color correction or lamps which approximate the color temperature of daylight, such as halogen lamps. One common type of prior art color correction was to employ a blue tinted glass cylinder around the incandescent lamp. A major disadvantage of halogen lamps and such color correction glass cylinders was their relative expense.

SUMMARY OF THE INVENTION

It is an object of the invention to provide a new and improved medical examining lamp.

A further object of the invention is to provide a medical examining lamp which is relatively simple and inexpensive.

A further object of the invention is to provide a medical examining lamp which provides an inexpensive means for color correcting incandescent lamps.

These and other objects and advantages of the invention will become more apparent from the detailed description of the preferred embodiment taken with the accompanying drawings.

In general terms, the invention comprises a medical examining lamp having a generally parabolic reflector and a socket disposed within the reflector for receiving an incandescent lamp wherein the reflector has a blue surface coating and a shield is mounted in the open end of the reflector and in alignment with the socket to prevent the direct projection of light rays from an incandescent lamp disposed within the socket.

DETAILED DESCRIPTION OF THE PREFERRED EMBODIMENTS

Figure 1:
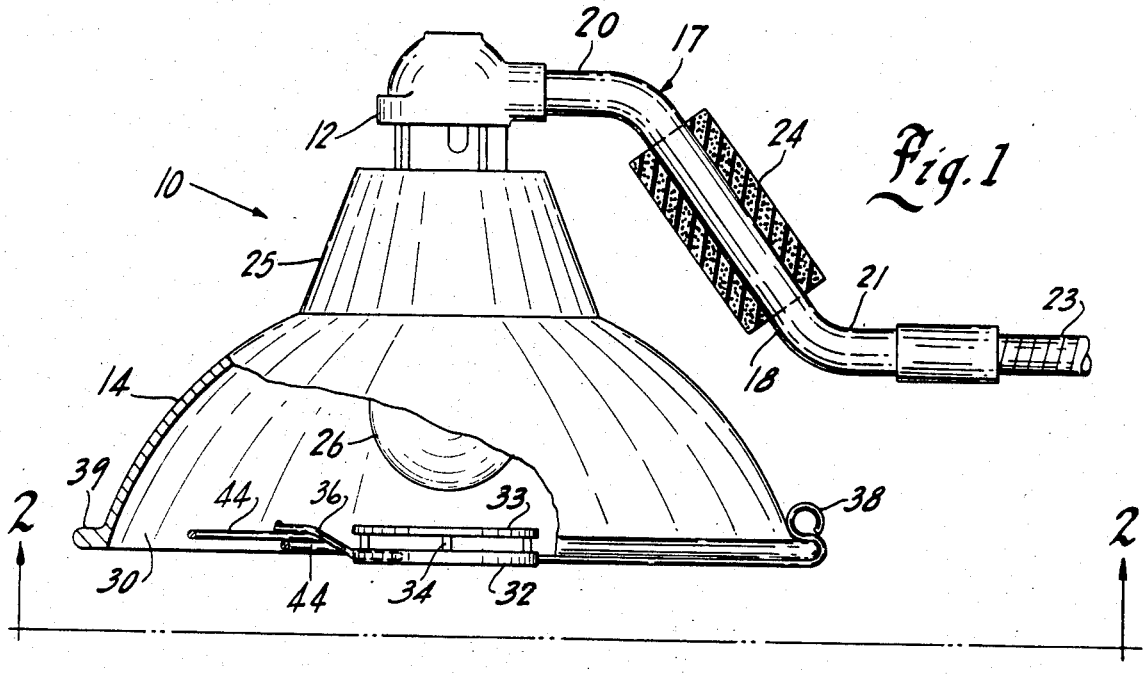
FIG. 1 is a side elevational view, with parts broken away, of the medical examining lamp in accordance with the preferred embodiment of an invention.
Figure 2:
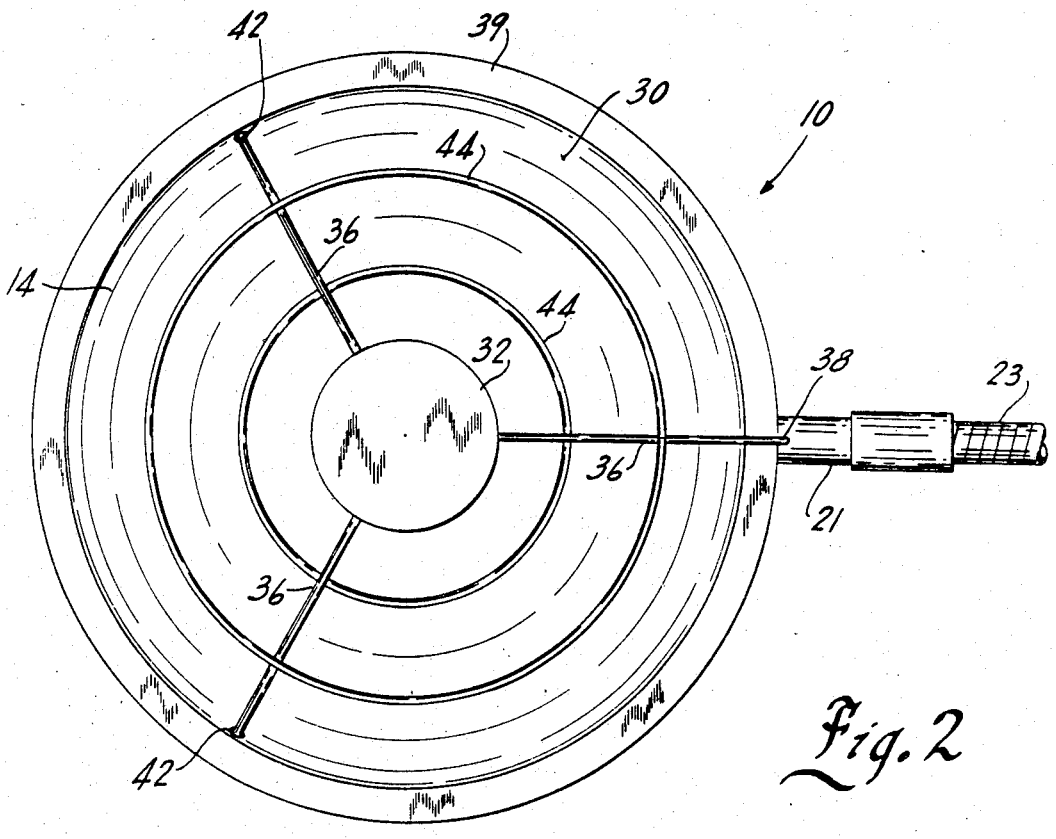
FIG. 2 is a bottom view of the medical examining lamp shown in FIG. 1.

The medical examining lamp 10, in accordance with the preferred embodiment of the invention, is shown in the drawings to include a lamp socket 12, a generally parabolic reflector 14 and a shield 15 disposed in the open end of reflector 14.

The socket 12 is conventional and is disposed at one end of a tubular member 17 having a center section 18 and offset end sections 20 and 21 which are formed at equal and opposite oblique angles relative to the central section 18. As those skilled in the art will appreciate, the socket 12 includes a conventional on-off switch, wiring and a threaded receptacle for an incandescent lamp.

The socket 12 is fixed to the end section 20 of tubular member 17 and section 21 of member 17 is fixed to a flexible tubular member 23. It will be appreciated, that the other end of the member 23 is fixed to a suitable support bracket (not shown) or stand (not shown). A hand grip 24, of a suitable heat insulating foam material, is mounted on the center section 18 to permit the operator to move the lamp 10 into a desired position by flexing the tubular member 23. Those skilled in the art will also appreciate that electrical conductors extend from the socket 12 through the tubular members 17 and 23 to a suitable source of electrical energy.

The reflector 14 includes a collar portion 25 which is suitably affixed to the socket 12 above the incandescent lamp 26. The socket 12 and the reflector 14 are preferably proportioned so that the nominal point source of light from lamp 26 lies at the focal center of the parabolic reflector 14.

The reflector 14 is preferably composed of aluminum with its inner parabolic surface 30 anodized with a blue finish. This is accomplished by including a blue dye in the anodizing solution. The blue color of the surface 30 preferably has a color temperature in the range of 3,000°-3,400° K. As a result, light reflected from the surface 30 will color correct the light emanating from the incandescent lamp 26 which is in the range of about 2,600°-2,900° K.

The shield includes a pair of circular plates 32 and 33 having a diameter approximately equal to that of the lamp 26 and is mounted centrally of the open end of reflector 14 to prevent the passage of light rays directly from lamp 26 to the patient. The plates 32 and 33 are attached in a parallel spaced apart relation by a plurality of short members 34. The air gap between the circular plates 32 and 33 provides a heat insulation whereby the plate 32 will be relatively cooler so that it may safely be contacted without injury.

The circular plates 32 and 33 are centrally mounted in the open end of reflector 14 by wire rods 36 which are fixed to the periphery of plate 32 and radiate outwardly therefrom. One of the rods 36 has an integral clip 38 formed thereon for engaging a flange 39 extending outwardly from the margin of the reflector 14. The ends of the other two rods 36 are received in holes 42 formed in the inner margin of flange 39. This permits the shield 15 to be removed readily. The shield may also include circular spaced apart safety members 44 attached to and bridging the gap between the rods 36.

While only a single embodiment of the invention has been illustrated and described, it is not intended to be limited thereby, but only by the scope of the appended claims.

I claim:

1. A medical examining lamp including a generally parabolic reflector having a peripheral margin and a socket mounted within the reflector for receiving an incandescent lamp, the reflector having a blue surface coating for color correcting the light emanating from the incandescent lamp and for reflecting the corrected light onto a patient, shield means having a periphery smaller than the peripheral margin of the reflector, mounting means supporting said shield means in a spaced relation to the peripheral margin of said reflector and in an opposed relation to the expected location of an incandescent lamp in said socket to permit the passage of reflected color corrected light between said shield means and said peripheral margin but preventing the projection of uncorrected light directly from said incandescent lamp onto such a patient, said shield means including first and second plates, coupling means for mounting said first plate in an opposed, generally parallel, spaced apart relation to said second plate, said first plate being disposed closer to the expected location of said incandescent lamp than said second plate and shielding said second plate from the heat generated by said incandescent lamp, the gap between said plates insulating the second plate from the heat of said first plate whereby said second plate remains relatively cooler.

2. The lamp set forth in claim 1 wherein the light eminating from said incandescent lamp has a color temperature of 2,600°–2,900° K., said surface color correcting said light to a range of from 3,000°–3,400° K.

3. The lamp set forth in claim 2 wherein said reflector is aluminum and said blue surface coating comprises a blue anodized coating.

* * * * *